US006072877A

United States Patent [19]

Abel

[11] Patent Number: 6,072,877

[45] Date of Patent: Jun. 6, 2000

[54] THREE-DIMENSIONAL VIRTUAL AUDIO DISPLAY EMPLOYING REDUCED COMPLEXITY IMAGING FILTERS

[75] Inventor: Jonathan S. Abel, Palo Alto, Calif.

[73] Assignee: Aureal Semiconductor, Inc., Fremont, Calif.

[21] Appl. No.: 08/907,309

[22] Filed: Aug. 6, 1997

Related U.S. Application Data

[63] Continuation of application No. 08/303,705, Sep. 9, 1994, Pat. No. 5,659,619.

[51] Int. Cl.[7] ..... H04R 5/00

[52] U.S. Cl. ..... 381/17

[58] Field of Search ..... 381/17, 18, 1, 381/61, 63

[56] References Cited

U.S. PATENT DOCUMENTS

| | | | |
|---|---|---|---|
| 4,941,178 | 7/1990 | Chuang | 704/241 |
| 5,404,406 | 4/1995 | Fuchigami et al. | 381/26 |
| 5,438,623 | 8/1995 | Begault | 381/17 |
| 5,440,639 | 8/1995 | Suzuki et al. | 381/17 |
| 5,659,619 | 8/1997 | Abel | 381/17 |

OTHER PUBLICATIONS

Rabiner, Lawrennce and Biing–Hwang Juang, Fundamentals of Speech Recognition, pps. 183–186, 1993.

*Primary Examiner*—Ping Lee
*Attorney, Agent, or Firm*—Ritter, Van Pelt & Yi LLP

[57] ABSTRACT

A three-dimensional virtual audio display method is described which includes generating a set of transfer function parameters in response to a spatial location or direction signal. An audio signal is filtered in response to the set of transfer function parameters. The set of transfer function parameters are selected from or interpolated among parameters derived by smoothing frequency components of a known transfer function over a bandwidth which is a non-constant function of frequency. The smoothing includes for each frequency component in at least part of the audio band of the display, applying a mean function to the amplitude of the frequency components within the bandwidth containing the frequency component, and noting the parameters of the resulting compressed transfer function.

5 Claims, 4 Drawing Sheets

THREE-DIMENSIONAL VIRTUAL AUDIO DISPLAY EMPLOYING REDUCED COMPLEXITY IMAGING FILTERS

This is a Continuation of prior application Ser. No. 08/303,705 filed on Sep. 9, 1994, U.S. Pat. No. 5,659,619.

BACKGROUND OF THE INVENTION

This invention relates generally to three-dimensional or "virtual" audio. More particularly, this invention relates to a method and apparatus for reducing the complexity of imaging filters employed in virtual audio displays. In accordance with the teachings of the invention, such reduction in complexity may be achieved without substantially affecting the psychoacoustic localization characteristics of the resulting three-dimensional audio presentation.

Sounds arriving at a listener's ears exhibit propagation effects which depend on the relative positions of the sound source and listener. Listening environment effects may also be present. These effects, including differences in signal intensity and time of arrival, impart to the listener a sense of the sound source location. If included, environmental effects, such as early and late sound reflections, may also impart to the listener a sense of an acoustical environment. By processing a sound so as to simulate the appropriate propagation effects, a listener will perceive the sound to originate from a specified point in three-dimensional space that is a "virtual" position. See, for example, "Headphone simulation of free-field listening" by Wightman and Kistler, *J. Acoust. Soc. Am.*, Vol. 85, No. 2, 1989.

Current three-dimensional or virtual audio displays are implemented by time-domain filtering an audio input signal with selected head-related transfer functions (HRTFs). Each HRTF is designed to reproduce the propagation effects and acoustic cues responsible for psychoacoustic localization at a particular position or region in three-dimensional space or a direction in three-dimensional space. See, for example, "Localization in Virtual Acoustic Displays" by Elizabeth M. Wenzel, *Presence*, Vol. 1, No. 1, Summer 1992. For simplicity, the present document will refer only to a single HRTF operating on a single audio channel. In practice, pairs of HRTFs are employed in order to provide the proper signals to the ears of the listener.

At the present time, most HRTFs are indexed by spatial direction only, the range component being taken into account independently. Some HRTFs define spatial position by including both range and direction and are indexed by position. Although particular examples herein may refer to HRTFs defining direction, the present invention applies to HRTFs representing either direction or position.

HRTFs are typically derived by experimental measurements or by modifying experimentally derived HRTFs. In practical virtual audio display arrangements, a table of HRTF parameter sets are stored, each HRTF parameter set being associated with a particular point or region in three-dimensional space. In order to reduce the table storage requirements, HRTF parameters for only a few spatial positions are stored. HRTF parameters for other spatial positions are generated by interpolating among appropriate sets of HRTF positions which are stored in the table.

As noted above, the acoustic environment may also be taken into account. In practice, this may be accomplished by modifying the HRTF or by subjecting the audio signal to additional filtering simulating the desired acoustic environment. For simplicity in presentation, the embodiments disclosed refer to the HRTFs, however, the invention applies more generally to all transfer functions for use in virtual audio displays, including HRTFs, transfer functions representing acoustic environmental effects and transfer functions representing both head-related transforms and acoustic environmental effects.

A typical prior art arrangement is shown in FIG. 1. A three-dimensional spatial location or position signal 10 is applied to an HRTF parameter table and interpolation function 11, resulting in a set of interpolated HRTF parameters 12 responsive to the three-dimensional position identified by signal 10. An input audio signal 14 is applied to an imaging filter 15 whose transfer function is determined by the applied interpolated HRTF parameters. The filter 15 provides a "spatialized" audio output suitable for application to one channel of a headphone 17.

Although the various Figures show headphones for reproduction, appropriate HRTFs may create psychoacoustically localized audio with other types of audio transducers, including loudspeakers. The invention is not limited to use with any particular type of audio transducer.

When the imaging filter is implemented as a finite-impulse-response (FIR) filter, the HRTF parameters define the FIR filter taps which comprise the impulse response associated with the HRTF. As discussed below, the invention is not limited to use with FIR filters.

The main drawback to the prior art approach shown in FIG. 1 is the computational cost of relatively long or complex HRTFs. The prior art employs several techniques to reduce the length or complexity of HRTFs. An HRTF, as shown in FIG. 2*a*, comprises a time delay D component and an impulse response g(t) component. Thus, imaging filters may be implemented as a time delay function $Z^{-D}$ and an impulse response function g(t), as shown in FIG. 2*b*. By first removing the time delay, thereby time aligning the HRTFs, the computational complexity of the impulse response function of the imaging filter is reduced.

FIG. 3*a* shows a prior art arrangement in which pairs of unprocessed or "raw" HRTF parameters 100 are applied to a time-alignment processor 101, providing at its outputs time-aligned HRTFs 102 and time-delay values 103 for later use (not shown). Processor 101 cross-correlates pairs of raw HRTFs to determine their time difference of arrival; these time differences are the delay values 103. Because the time delay value values 103 and the filter terms are retained for later use, there is no psychoacoustic localization loss—the perceptual impact is preserved. Each time-aligned HRTF 102 is then processed by a minimum-phase converter 104 to remove residual time delay and to further shorten the time-aligned HRTFs.

FIG. 3*b* shows two left-right pairs (R1/L1 and R2/L2) of exemplary raw HRTFs resulting from raw HRTF parameters 100. FIG. 3*c* shows corresponding time-aligned HRTFs 102. FIG. 3*d* shows the corresponding output minimum-phase HRTFs 105. The impulse response lengths of the time-aligned HRTFs 102 are shortened with respect to the raw HRTFs 100 and the minimum-phase HRTFs 105 are shortened with respect to the time-aligned HRTFs 102. Thus, by extracting the delay so as to time align the HRTFs and by applying minimum phase conversion, the filter complexity (its length, in the case of an FIR filter) is reduced.

Despite the use of the techniques of FIGS. 2*b* and 3*a*, at an audio sampling rate of 48 kHz, minimum phase responses as long as 256 points for an FIR filter are commonly used, requiring processors executing on the order of 25 mips per audio source rendered.

When computational resources are limited, two additional approaches are used in the prior art, either singly or in combination, to further reduce the length or complexity of HRTFs. One technique is to reduce the sampling rate by down sampling the HRTF as shown in FIG. 4*a*. Since many localization cues, particularly those important to elevation, involve high-frequency components, reducing the sampling rate may unacceptably degrade the performance of the audio display.

Another technique, shown in FIG. 4*b*, is to apply a windowing function to the HRTF by multiplying the HRTF by a windowing function in the time domain or by convolving the HRTF with a corresponding weighting function in the frequency domain. This process is most easily understood by considering the multiplication of the HRTF by a window in the time domain—the window width is selected to be narrower than the HRTF, resulting in a shortened HRTF. Such windowing results in a frequency-domain smoothing with a fixed weighting function. This known windowing technique degrades psychoacoustic localization characteristics, particularly with respect to spatial positions or directions having complex or long impulse responses. Thus, there is a need for a way to reduce the complexity or length of HRTFs while maintaining the perceptual impact and psychoacoustic localization characteristics of the original HRTFs.

SUMMARY OF THE INVENTION

In accordance with the present invention, a three-dimensional virtual audio display generates a set of transfer function parameters in response to a spatial location signal and filters an audio signal in response to the set of head-related transfer function parameters. The set of head-related transfer function parameters are smoothed versions of parameters for known head-related transfer functions.

The smoothing according to the present invention is best explained by considering its action in the frequency domain: the frequency components of known transfer functions are smoothed over bandwidths which are a non-constant function of frequency. The parameters of the resulting transfer functions, referred to herein as "compressed" transfer functions, are used to filter the audio signal for the virtual audio display. The compressed head-related transfer function parameters may be prederived or may be derived in real time. Preferably, the smoothing bandwidth is a function of the width of the ear's critical bands (i.e., a function of "critical bandwidth"). The function may be such that the smoothing bandwidth is proportional to critical bandwidth. As is well known, the ear's critical bands increase in width with increasing frequency, thus the smoothing bandwidth also increases with frequency.

The wider the smoothing bandwidth relative to the critical bandwidth, the less complex the resulting HRTF. In the case of an HRTF implemented as an FIR filter, the length of the filter (the number of filter taps) is inversely related to the smoothing bandwidth expressed as a multiple of critical bandwidth.

By applying the teachings of the present invention which take critical bandwidth into account, for the same reduction in complexity or length, the resulting less complex or shortened HRTFs have less degradation of perceptual impact and psychoacoustic localization than HRTFs made less complex or shortened by prior art windowing techniques such as described above.

An example HRTF ("raw HRTF") and shortened versions produced by a prior art windowing method ("prior art HRTF") and by the method according to the present invention ("compressed HRTF") are shown in FIGS. 5*a* (time domain) and 5*b* (frequency domain). The raw HRTF is an example of a known HRTF that has not been processed to reduce its complexity or length. In FIG. 5*a*, the HRTF time-domain impulse response amplitudes are plotted along a time axis of 0 to 3 milliseconds. In FIG. 5*b* the frequency-domain transfer function power of each HRTF is plotted along a log frequency axis extending from 1 kHz to 20 kHz. In the time domain, FIG. 5*a*, the prior art HRTF exhibits some shortening, but the compressed HRTF exhibits even more shortening. In the frequency domain, FIG. 5*b*, the effect of uniform smoothing bandwidth on the prior art HRTF is apparent, whereas the compressed HRTF shows the effect of an increasing smoothing bandwidth as frequency increases. Because of the log frequency scale of FIG. 5*b*, the compressed HRTF displays a constant smoothing with respect to the raw HRTF. Despite their differences in time-domain length and frequency-domain frequency response, the raw HRTF, the prior art HRTF, and the compressed HRTF provide comparable psychoacoustic performance.

When the amount of prior art windowing and compression according to the present invention are chosen so as to provide substantially similar psychoacoustic performance with respect to raw HRTFs, preliminary double-blind listening tests indicate a preference for compressed HRTFs over prior art windowed HRTFs. Somewhat surprisingly, compressed HRTFs were also preferred over raw HRTFs. This is believed to be because the HRTF fine structure eliminated by the smoothing process is uncorrelated from HRTF position to HRTF position and may be perceived as a form of noise.

The present invention may be implemented in at least two ways. In a first way, an HRTF is smoothed by convolving the HRTF with a frequency dependent weighting function in the frequency domain. This weighting function differs from the frequency domain dual of the prior art time-domain windowing function in that the weighting function varies as a function of frequency instead of being invariant. Alternatively, a time-domain dual of the frequency dependent weighting function may be applied to the HRTF impulse response in the time domain. In a second way, the HRTF's frequency axis is warped or mapped into a non-linear frequency domain and the frequency-warped HRTF is either multiplied by a conventional window function in the time domain (after transformation to the time domain) or convolved with the non-varying frequency response of the conventional window function in the frequency domain. Inverse frequency warping is subsequently applied to the windowed signal.

The present invention may be implemented using any type of imaging filter, including, but not limited to, analog filters, hybrid analog/digital filters, and digital filters. Such filters may be implemented in hardware, software or hybrid hardware/software arrangements, including, for example, digital signal processing. When implemented digitally or partially digitally, FIR, IIR (infinite-impulse-response)and hybrid FIR/IIR filters may be employed. The present invention may also be implemented by a principal component filter architecture. Other aspects of the virtual audio display may be implemented using any combination of analog, digital, hybrid analog/digital, hardware, software, and hybrid hardware/software techniques, including, for example, digital signal processing.

In the case of an FIR filter implementation, the HRTF parameters are the filter taps defining the FIR filter. In the case of an IIR filter, the HRTF parameters are the poles and zeroes or other characteristics defining the IIR filter. In the case of a principal component filter, the HRTF parameters are the position-dependent weights.

In another aspect of the invention, each HRTF in a group of HRTFs is split into a fixed head-related transfer function common to all head-related transfer functions in the group and a variable head-related transfer function associated with respective head-related transfer functions, the combination of the fixed and each variable head-related transfer function being substantially equivalent to the respective original known head-related transfer function. The smoothing techniques according to the present invention may be applied to either the fixed HRTF, the variable HRTF, to both, or to neither of them.

DESCRIPTION OF THE PREFERRED EMBODIMENTS

Figure 6A:
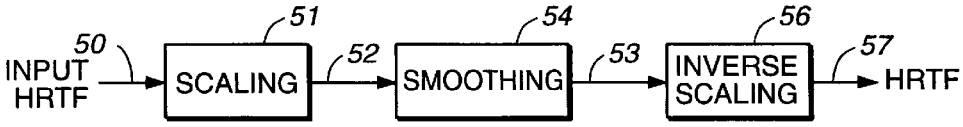
FIG. 6*a* is a functional block diagram showing an embodiment for deriving compressed HRTFs according to the present invention.

FIG. 6*a* shows an embodiment for deriving compressed HRTFs according to the present invention. According to this embodiment, an input HRTF is smoothed by convolving the frequency response of the input HRTF with a frequency dependent weighting function in the frequency domain. Alternatively, a time-domain dual of the frequency dependent weighting function may be applied to the HRTF impulse response in the time domain.

Figure 7A:
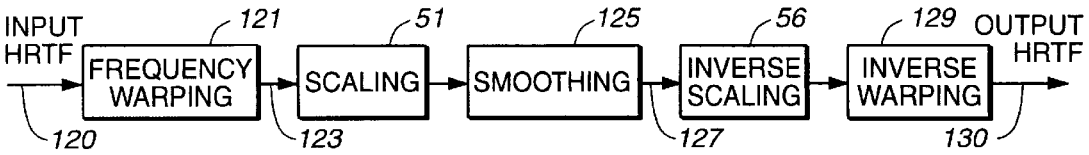
FIG. 7*a* shows an alternative embodiment for deriving compressed HRTFs according to the present invention.

FIG. 7*a* shows an alternative embodiment for deriving compressed HRTFs according to the present invention. According to this embodiment, the frequency axis of the input HRTF is warped or mapped into a non-linear frequency domain and the frequency-warped HRTF is convolved with the frequency response of a non-varying weighting function in the frequency domain (a weighting function which is the dual of a conventional time-domain windowing function). Inverse frequency warping is then applied to the smoothed signal. Alternatively, the frequency-warped HRTF may be transformed into the time domain and multiplied by a conventional window function.

Referring to FIG. 6*a*, an optional nonlinear scaling function 51 is applied to an input HRTF 50. A smoothing function 54 is then applied to the HRTF 52. If nonlinear scaling is applied to the input HRTF, an inverse scaling function 56 is then applied to the smoothed HRTF 54. A compressed HRTF 57 is provided at the output. As explained further below, the nonlinear scaling 51 and inverse scaling 56 can control whether the smoothing mean function is with respect to signal amplitude or power and whether it is an arithmetic averaging, a geometric averaging or another mean function.

The smoothing processor 54 convolves the HRTF with a frequency-dependent weighting function. The smoothing processor may be implemented as a running weighted arithmetic mean, $$S(f) = \frac{1}{2b_f + 1} \sum_{n=-b_f}^{b_f} W_f(n) \cdot H(f - n), \qquad \text{Equation 1.}$$

where at least the smoothing bandwidth $b_f$ and, optionally, the window shape $W_f$ are a function of frequency. The width of the weighting function increases with frequency; preferably, the weighting function length is a multiple of critical bandwidth: the shorter the required HRTF impulse response length, the greater the multiple.

HRTFs typically lack low-frequency content (below about 300 Hz) and high-frequency content (above about 16 kHz). In order to provide the shortest possible (and, hence, least complex) HRTFs, it is desirable to extend HRTF frequency response to or even beyond the normal lower and upper extremes of human hearing. However, if this is done, the width of the weighting function in the extended low-frequency and high-frequency audio-band regions should be wider relative to the ear's critical bands than the multiple of critical bandwidth used through the main, unextended portion of the audio band in which HRTFs typically have content.

Below about 500 Hz, HRTFs are approximately flat spectrally because audio wavelengths are large compared to head size. Thus, a smoothing bandwidth wider than the above-mentioned multiple of critical bandwidth preferably is used. At high frequencies, above about 16 kHz, a smoothing bandwidth wider than the above-mentioned multiple of critical bandwidth preferably is also used because human hearing is poor at such high frequencies and most localization cues are concentrated below such high frequencies.

Thus, the weighting bandwidth at the low-frequency and high-frequency extremes of the audio band preferably may be widened beyond the bandwidths predicted by the equations set forth herein. For example, in one practical embodiment of the invention, a constant smoothing bandwidth of about 250 Hz is used for frequencies below 1 kHz, and a third-octave bandwidth is used above 1 kHz. One-third octave bandwidth approximates critical bandwidth; at 1 kHz the one-third octave bandwidth is about 250 Hz. Thus, below 1 kHz the smoothing bandwidth is wider than the critical bandwidth. In some cases, power noted at low frequencies (say, in the range 300 to 500 Hz) is extrapolated to DC to fill in data not accurately determined using conventional HRTF measurement techniques.

Although a weighting function having the same multiple of critical bandwidth may be used in processing all of the HRTFs in a group, weighting functions having different critical bandwidth multiples may be applied to respective HRTFs so that not all HRTFs are compressed to the same extent—this may be necessary in order to assure that the resulting compressed HRTFs are generally of the same complexity or length (certain ones of the raw HRTFs will be of greater complexity or length depending on the spatial location which they represent and may therefore require greater or lesser compression). Alternatively, HRTFs representing certain directions or spatial positions may be compressed less than others in order to maintain the perception of better overall spatial localization while still obtaining some overall lessening in computational complexity. The amount of HRTF compression may be varied as a function of the relative psychoacoustic importance of the HRTF. For example, early reflections, which are rendered using separate HRTFs because they arrive from different directions, are not as important to spatialize as accurately as is the direct sound path. Thus, early reflections could be rendered using "over shortened" HRTFs without perceptual impact.

Another way to view the smoothing 54 of FIG. 6*a* is that for each frequency $f$, $$S_\theta(f) = \sum_{n=0}^{N} W_{f,\theta}(n) \cdot H_\theta(n), \qquad \text{Equation 2.}$$

$$\text{where } \sum_{n=0}^{n=N} W_{f,\theta}(n) = 1, \qquad \text{Equation 3.}$$

$$W_{f,\theta}(n) \geq 0, \quad \text{for all } n, \qquad \text{Equation 4.}$$

Figure 8:
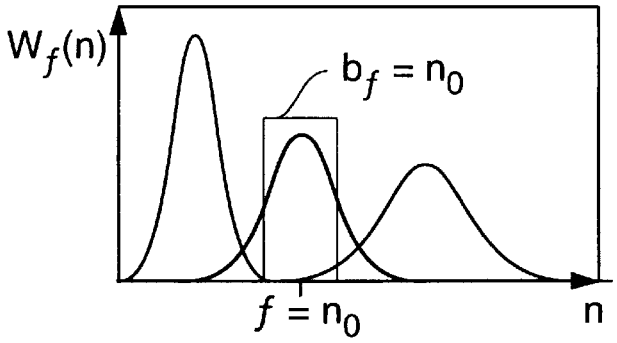
FIG. 8 shows three of a family of windows useful in understanding the operation of the embodiments of FIGS. 6*a* and 7*a*.

$H_\theta(n)$ is the input HRTF 52 at position θ, $S_\theta(f)$ is the compressed HRTF 54, n is frequency, and N is one half the Nyquist frequency. Thus, there are a family of weighting functions $W_{f,\theta}(n)$, each defined on an interval 0 to N, which have a width which is a function of their center frequency $f$ and, optionally, also a function of the HRTF position θ. The summation of each weighting function is 1 (Equation 3). FIG. 8 shows three members of a family of Gaussian-shaped weighting functions with their amplitude response plotted against frequency. Only three of the family of weighting functions are shown for simplicity. The center window is centered at frequency $n_0$ and has a bandwidth $b_{f=n}$. The weighting functions need not have a Gaussian shape. Other shaped weighting functions, including rectangular, for simplicity, may be employed. Also, the weighting functions need not be symmetrical about their center frequency.

Taking into account the nonlinear scaling function 51 and the inverse scaling function 56, FIG. 6*a* may be more generally characterized as $$S_\theta(f) = G^{-1}\left\{\sum_{n=0}^{N} W_{f,\theta}(n) \cdot G\{H_\theta(n)\}\right\} \qquad \text{Equation 5.}$$

where G is the scaling 51 and $G^{-1}$ is the inverse scaling.

While the smoothing 54 thus far described provides an arithmetic mean function, depending on the statistics of the input HRTF transfer function, a trimmed mean or median might be favored over the arithmetic mean.

Because the human ear appears to be sensitive to the total filter power in a critical band, it is preferred to implement the nonlinear scaling 51 of FIG. 6*a* as a magnitude squared operation and the output inverse scaler 56 as a square root. It may be desirable to apply certain pre-processing or post-processing such as minimum phase conversion. Alternatively, or in addition to the magnitude squared scaling and square root inverse scaling, the arithmetic mean of the smoothing 54 becomes a geometric mean when the nonlinear scaling 51 provides a logarithm function and the inverse scaling 56 an exponentiation function. Such a mean is useful in preserving spectral nulls thought to be important for elevation perception.

Figure 6B:
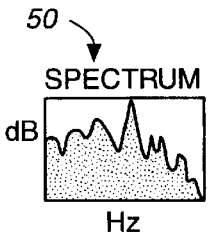
FIG. 6*b* shows the frequency response of an exemplary input HRTF.
Figure 6C:
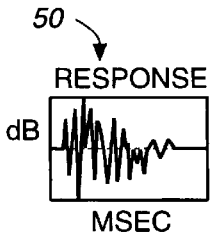
FIG. 6*c* shows the impulse response of the exemplary input HRTF impulse response.
Figure 6D:
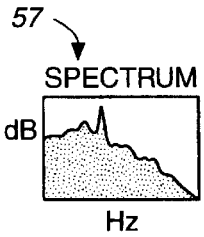
FIG. 6*d* shows the frequency response of the compressed output HRTF.
Figure 6E:
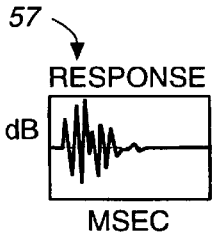
FIG. 6*e* shows the impulse response of the compressed output HRTF.

FIGS. 6*b* and 6*c* show an exemplary input HRTF frequency spectrum and input impulse response, respectively, in the frequency domain and the time domain. FIGS. 6*d* and 6*e* show the compressed output HRTF 57 in the respective domains. The degree to which the HRTF spectrum is smoothed and its impulse response is shortened will depend on the multiple of critical bandwidth chosen for the smoothing 54. The compressed HRTF characteristics will also depend on the window shape and other factors discussed above.

Refer now to FIG. 7*a*. In this embodiment the frequency axis of the input HRTF is altered by a frequency warping function 121 so that a constant-bandwidth smoothing 125 acting on the warped frequency spectrum implements the equivalent of smoothing 54 of FIG. 6*a*. The smoothed HRTF is processed by an inverse warping 129 to provide the output compressed HRTF. In the same manner as in FIG. 6*a*, nonlinear scaling 51 and inverse scaling 56 optionally may be applied to the input and output HRTFs.

The frequency warping function 121 in conjunction with constant bandwidth smoothing serves the purpose of the frequency-varying smoothing bandwidth of the FIG. 7*a* embodiment. For example, a warping function mapping frequency to Bark may be used to implement critical-band smoothing. Smoothing 125 may be implemented as a time-domain window function multiplication or as a frequency-domain weighting function convolution similar to the embodiment of FIG. 6*a* except that the weighting function width is constant with frequency. As with respect to FIG. 6*a*, it may be desirable to apply certain pre-processing or post-processing such as minimum phase conversion.

The order in which the frequency warping function 121 and the scaling function 51 are applied may be reversed. Although these functions are not linear, they do commute because the frequency warping 121 affects the frequency domain while the scaling 51 affects only the value of the frequency bins. Consequently, the inverse scaling function 56 and the inverse warping function 129 may also be reversed.

As a further alternative, the output HRTF may be taken after block 125, in which case inverse scaling and inverse warping may be provided in the apparatus or functions which receive the compressed HRTF parameters.

Figure 7B:
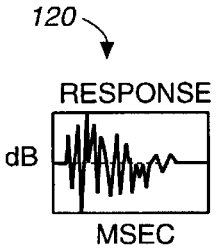
FIG. 7*b* shows the impulse response of an exemplary input HRTF impulse response.
Figure 7C:
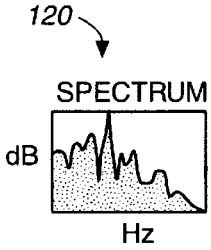
FIG. 7*c* shows the frequency response of the exemplary input HRTF.
Figure 7D:
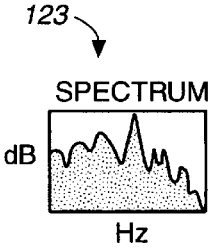
FIG. 7*d* shows the frequency response of the input HRTF after frequency warping.
Figure 7E:
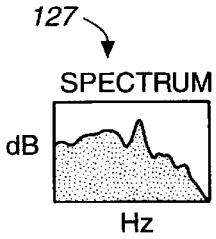
FIG. 7*e* shows the frequency response of the compressed output HRTF.
Figure 7F:
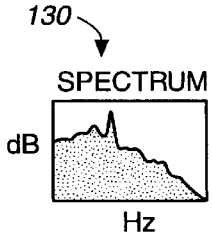
FIG. 7*f* shows the frequency response of the compressed output HRTF after inverse frequency warping.
Figure 7G:
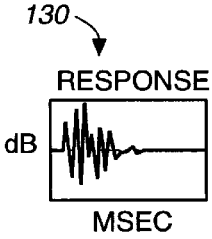
FIG. 7*g* shows the impulse response of the compressed output HRTF after inverse frequency warping.

FIGS. 7*b* and 7*c* show an exemplary input HRTF input response and frequency spectrum, respectively. FIG. 7*d* shows the frequency spectrum of the HRTF mapped into Bark. FIG. 7*e* shows the spectrum of the HRTF after smoothing 125. After undergoing inverse frequency warping, the resulting compressed HRTF has a spectrum as shown in FIG. 7*f* and an impulse response as shown in FIG. 7*g*. It will be noted that the resulting HRTF characteristics are the same as those of the embodiment of FIG. 6*a*.

Figure 1:
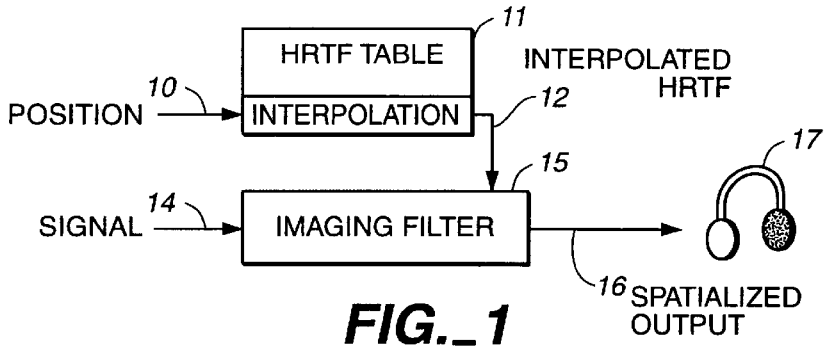
FIG. 1 is a functional block diagram of a prior art virtual audio display arrangement.
Figure 2A:
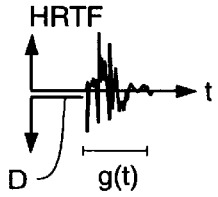
FIG. 2*a* is an example of the impulse response of a head-related transfer function (HRTF).
Figure 2B:
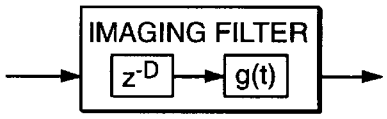
FIG. 2*b* is a functional block diagram illustrating the manner in which an imaging filter may represent the time-delay and impulse response portions of an HRTF.
Figure 3A:
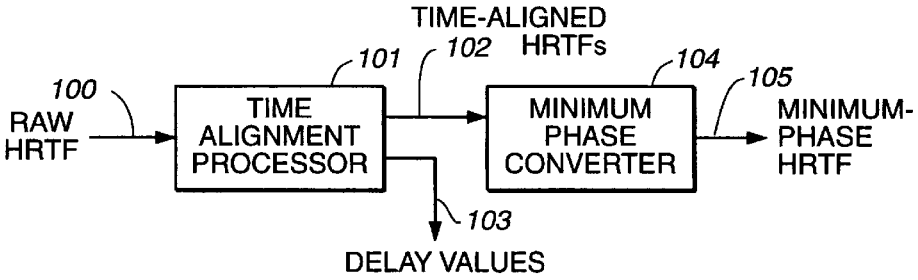
FIG. 3*a* is a functional block diagram of one prior art technique for reducing the complexity or length of an HRTF.
Figure 3B:
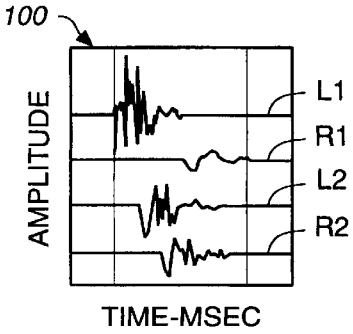
FIG. 3*b* is a set of example left and right "raw" HRTF pairs.
Figure 3C:
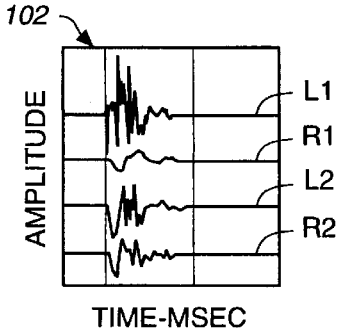
FIG. 3*c* is the set of HRTF pairs as in FIG. 3*b* which are now time aligned to reduce their length.
Figure 3D:
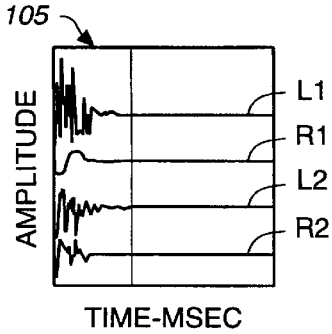
FIG. 3*d* is the set of HRTF pairs as in FIG. 3*c* which are now minimum phase converted to further reduce their length.
Figure 4A:
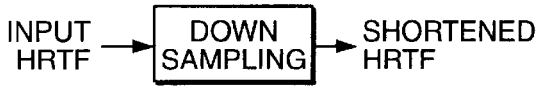
FIG. 4*a* is a functional block diagram showing a prior art technique for shortening an HRTF impulse response by reducing the sampling rate.
Figure 4B:
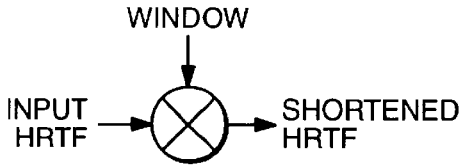
FIG. 4*b* is a functional block diagram showing a prior art technique for shortening an HRTF impulse response by multiplying it by a window in the time domain.
Figure 5A:
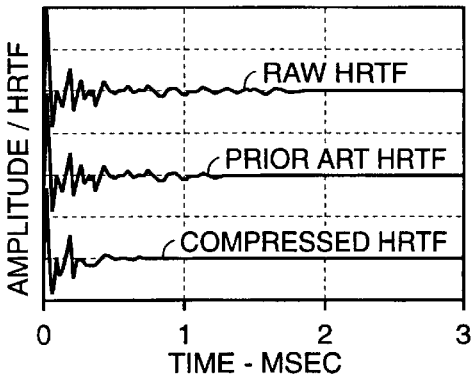
FIG. 5*a* is a set of three waveforms in the time domain, illustrating an example of a "raw" HRTF, the HRTF shortened by prior art techniques and the HRTF compressed according to the teachings of the present invention.
Figure 5B:
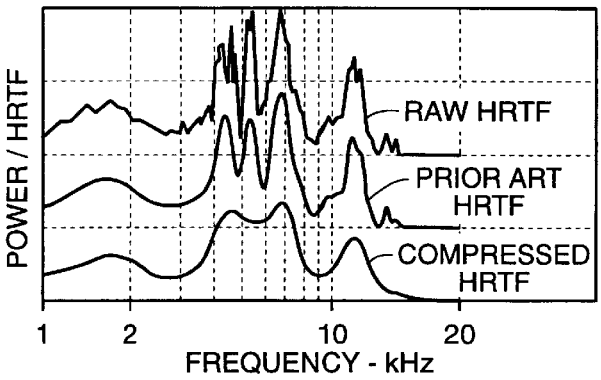
FIG. 5*b* is a frequency domain representation of the set of HRTF waveforms of FIG. 5*a*.
Figure 9:
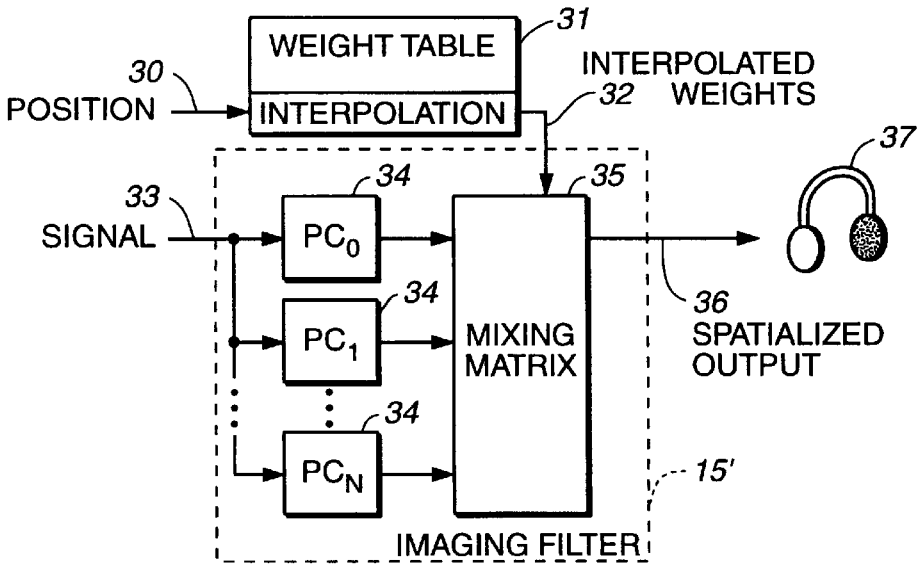
FIG. 9 is a functional block diagram in which the imaging filter is embodied as a principal component filter.

The imaging filter may also be embodied as a principal component filter in the manner of FIG. 9. A position signal 30 is applied to a weight table and interpolation function 31 which is functionally similar to block 11 of FIG. 1. The parameters provided by block 31, the interpolated weights, the directional matrix and the principal component filters are functionally equivalent to HRTF parameters controlling an imaging filter. The imaging filter 15' of this embodiment filters the input signal 33 in a set of parallel fixed filters 34, principal component filters, $PC_0$ through $PC_N$, whose outputs are mixed via a position-dependent weighting to form an approximation to the desired imaging filter. The accuracy of the approximations increase with the number of principal component filters used. More computational resources, in the form of additional principal component filters, are needed to achieve a given degree of approximation to a set of raw HRTFs than to versions compressed in accordance with this embodiment of the present invention.

Figure 10:
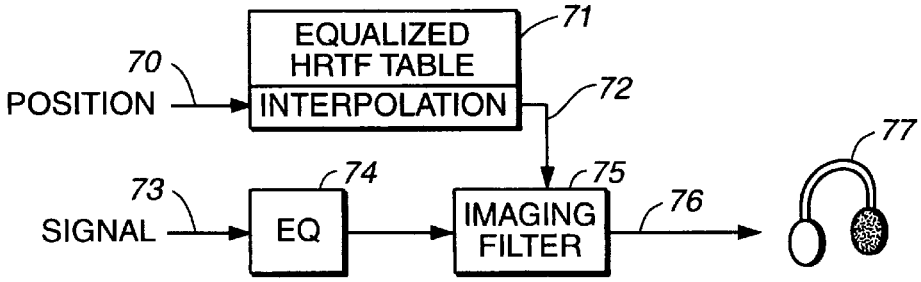
FIG. 10 is a functional block diagram showing another aspect of the present invention.

Another aspect of the invention is shown in the embodiment of FIG. 10. A three-dimensional spatial location or position signal 70 is applied to an equalized HRTF parameter table and interpolation function 71, resulting in a set of interpolated equalized HRTF parameters 72 responsive to the three-dimensional position identified by signal 70. An input audio signal 73 is applied to an equalizing filter 74 and an imaging filter 75 whose transfer function is determined by the applied interpolated equalized HRTF parameters. Alternatively, the equalizing filter 74 may be located after the imaging filter 75. The filter 75 provides a spatialized audio output suitable for application to one channel of a headphone 77.

The sets of equalized head-related transfer function parameters in the table 71 are prederived by splitting a group of known head-related transfer functions into a fixed head-related transfer function common to all head-related transfer functions in the group and a variable, position-dependent head-related transfer function associated with each of the known head-related transfer functions, the combination of the fixed and each variable head-related transfer function being substantially equal to the respective original known head-related transfer function. The equalizing filter 74 thus represents the fixed head-related transfer function common to all head-related transfer functions in the table. In this manner the HRTFs and imaging filter are reduced in complexity.

The equalization filter characteristics are chosen to minimize the complexity of the imaging filters. This minimizes the size of the equalized HRTF table, reduces the computational resources for HRTF interpolation and image filtering and reduces memory resources for tabulated HRTFs. In the case of FIR imaging filters, it is desired to minimize filter length.

Various optimization criteria may be used to find the desired equalization filter. The equalization filter may approximate the average HRTF, as this choice makes the position-dependent portion spectrally flat (and short in time) on average. The equalization filter may represent the diffuse field sound component of the group of known transfer functions. When the equalization filter is formed as a weighted average of HRTFs, the weighting should give more importance to longer or more complex HRTFs.

Different fixed equalization may be provided for left and right channels (either before or after the position variable HRTFs) or a single equalization may be applied to the monaural source signal (either as a single filter before the monaural signal is split into left and right components or as two filters applied to each of the left and right components). As might be expected from human symmetry, the optimal left-ear and right-ear equalization filters are often nearly identical. Thus, the audio source signal may be filtered using a single equalization filter, with its output passed to both position-dependent HRTF filters.

Further benefits may be achieved by smoothing either the equalized HRTF parameters, the parameters of the fixed equalizing filter or both the equalized HRTF parameters and equalizing filter parameters in accordance with the teachings of the present invention.

Also, using different filter structures for the equalization filter and the imaging filter may result in computational savings: for example, one may be implemented as an IIR filter and the other as an FIR filter. Because it is a fixed filter typically with a fairly smooth response, the equalizing filter may best be implemented as a low-order IIR filter. Also, it could readily be implemented as an analog filter.

Any filtering technique appropriate for use in HRTF filters, including principal component methods, may be used to implement the variable, position-dependent portion equalized HRTF parameters. For example, FIG. 10 may be modified to employ as imaging filter 75 a principal component imaging filter 15' of the type described in connection with the embodiment of FIG. 9.

I claim:

1. A three-dimensional virtual audio display method comprising:

generating a set of transfer function parameters in response to a spatial location or direction signal, and filtering an audio signal in response to said set of transfer function parameters, wherein said set of transfer function parameters are selected from or interpolated among parameters derived by smoothing the amplitude of the frequency components of a known transfer function over a bandwidth which is a non-constant function of frequency wherein said smoothing includes applying a frequency warping function to said known transfer function wherein said frequency warping function maps frequency to a nonlinear scale to implement the equivalent of critical band smoothing, applying a non-linear amplitude scaling to said frequency-warped transfer function, transforming the frequency-warped transfer function to the time domain, time-domain windowing the impulse response of the frequency-warped transfer function, and noting the parameters of the resulting compressed transfer function.

2. A three-dimensional virtual audio display method as recited in claim 1 wherein the nonlinear scale is the Bark scale.

3. A three-dimensional virtual audio display method comprising:

generating a set of transfer function parameters in response to a spatial location or direction signal, and filtering an audio signal in response to said set of transfer function parameters, wherein said set of transfer function parameters are selected from or interpolated among parameters derived by smoothing the amplitude of the frequency components of a known transfer function over a bandwidth which is a non-constant function of frequency wherein said smoothing includes applying a frequency warping function to said known transfer function, said frequency warping function mapping frequency to a nonlinear scale to implement the equivalent of critical band smoothing, frequency-domain convolving the non-linear amplitude sealed frequency-warped transfer function with a constant bandwidth weighting function and noting the parameters of the resulting compressed transfer function.

4. A three-dimensional virtual audio display method as recited in claim 3 wherein the nonlinear scale is the Bark scale.

5. A three-dimensional virtual audio display method comprising:

generating a set of transfer function parameters in response to a spatial location or direction signal, and filtering an audio signal in response to said set of transfer function parameters, wherein said set of transfer function parameters are selected from or interpolated among parameters derived by smoothing the amplitude of the frequency components of a known transfer function over a bandwidth which is a non-constant function of frequency wherein said smoothing includes applying a frequency warping function to said known transfer function wherein said frequency warping function maps the transfer function to Bark to implement the equivalent of critical band smoothing, and noting the parameters of the resulting compressed transfer function.

* * * * *